US009963851B2

(12) United States Patent
Francovich, Jr. et al.

(10) Patent No.: US 9,963,851 B2
(45) Date of Patent: May 8, 2018

(54) UNDERGROUND ACCESS COVERS AND METHODS OF ASSEMBLING THE SAME

(71) Applicant: Utility Access Solutions and Maintenance Co., LLC, Reno, NV (US)

(72) Inventors: Samuel Boyd Francovich, Jr., Reno, NV (US); Raymond Michael Pezonella, Reno, NV (US)

( * ) Notice: Subject to any disclaimer, the term of this patent is extended or adjusted under 35 U.S.C. 154(b) by 41 days.

(21) Appl. No.: 14/990,516

(22) Filed: Jan. 7, 2016

(65) Prior Publication Data

US 2017/0198455 A1 Jul. 13, 2017

(51) Int. Cl.
*E02D 29/14* (2006.01)

(52) U.S. Cl.
CPC ..... *E02D 29/14* (2013.01); *E02D 2300/0001* (2013.01)

(58) Field of Classification Search
CPC . E02D 29/14; E02D 29/1472; E02D 29/1409; E02D 2300/0001
See application file for complete search history.

(56) References Cited

U.S. PATENT DOCUMENTS 166,574 A * 8/1875 Wilbur ..... E02D 29/14 404/25
611,640 A * 10/1898 Maher ..... E02D 29/14 404/25
3,308,727 A * 3/1967 Hurt, Jr. ..... E02D 29/14 277/645
4,187,647 A * 2/1980 Hall ..... E02D 29/1409 404/26
4,454,039 A * 6/1984 McCoy ..... E03F 5/06 210/164
4,861,186 A * 8/1989 Ferns ..... E02D 29/14 404/25
5,052,152 A * 10/1991 Weddendorf ..... E06B 7/2312 49/480.1
RE34,550 E * 2/1994 Bowman ..... E02D 29/124 404/26
5,549,411 A * 8/1996 Hawkins ..... E02D 29/14 404/25
6,769,834 B1 * 8/2004 Stange ..... E02D 29/1409 404/25
6,945,731 B1 * 9/2005 Vait ..... G09F 17/00 116/173
7,165,911 B2 * 1/2007 Fier ..... E02D 29/1409 404/25
7,914,227 B2 3/2011 Jordan et al.
8,118,517 B2 2/2012 Kelley et al.
D724,758 S 3/2015 Lumme, Jr. et al.
2002/0098038 A1 7/2002 Hassler
2002/0176743 A1 11/2002 Shumlansky et al.
2008/0168719 A1 * 7/2008 Borunda ..... E04G 21/3204 52/20

(Continued)

*Primary Examiner* — Abigail A Risic
(74) *Attorney, Agent, or Firm* — Armstrong Teasdale LLP

(57) ABSTRACT

An underground access cover includes a substantially non-metallic base having a diameter. The underground access cover also includes a substantially non-metallic cap coupled to the base. The cap has a diameter that is longer than the diameter of the base such that the cap extends radially outward from the base to define a flange of the cover.

8 Claims, 6 Drawing Sheets

(56) References Cited

U.S. PATENT DOCUMENTS

| | | | | |
|---|---|---|---|---|
| 2009/0214292 | A1* | 8/2009 | Crissman | E02D 29/14 404/26 |
| 2009/0297265 | A1* | 12/2009 | Wood | E02D 29/1409 404/26 |
| 2010/0124458 | A1* | 5/2010 | Munro | E02D 29/12 404/26 |

* cited by examiner

UNDERGROUND ACCESS COVERS AND METHODS OF ASSEMBLING THE SAME

BACKGROUND

The field of this disclosure relates generally to underground access covers and, more particularly, underground access covers for openings in pavement.

Underground access through pavement is often required. For example, it is common for at least some utilities (e.g., water, gas, and electric lines) to run underneath paved roadways, and the roadways typically have openings in the pavement for accessing the utilities. A removable cover is usually placed over each opening to prevent vehicles, people, and other objects from falling into the opening. However, as a result of improper installation, ground settling, and/or roadway repaving, it is common for known covers to become improperly positioned over time (e.g., covers often loosen in their support frames and/or become severely recessed relative the surrounding pavement).

When a vehicle traverses an improperly positioned cover, an unpleasant noise can be generated, and an undesirable amount of wear-and-tear can be imparted to the vehicle. Additionally, surface water can infiltrate improperly positioned covers, thereby damaging the utilities underneath the roadway. For at least these reasons, it is desirable to periodically repair improperly positioned covers on paved roadways, but conventional repair procedures have been known to be overly labor intensive, time consuming, and expensive. Improvements would therefore be useful.

BRIEF DESCRIPTION

In one aspect, an underground access cover is provided. The underground access cover includes a substantially non-metallic base having a diameter. The underground access cover also includes a substantially non-metallic cap coupled to the base. The cap has a diameter that is longer than the diameter of the base such that the cap extends radially outward from the base to define a flange of the cover.

In another aspect, a method of assembling an underground access cover is provided. The method includes forming a base from a substantially non-metallic material such that the base has a diameter. The method also includes forming a cap from a substantially non-metallic material such that the cap has a diameter that is longer than the diameter of the base. The method further includes coupling the cap to the base such that the cap extends radially outward from the base to define a flange of the cover.

In another aspect, a method of repairing a cover assembly recessed in pavement is provided. The method includes removing a cover from a support frame of the cover assembly and coupling a riser to the support frame. The method also includes paving between the pavement and the riser and positioning the cover on the riser.

DETAILED DESCRIPTION

The following detailed description illustrates underground access covers and methods of assembling the same by way of example and not by way of limitation. The description should enable one of ordinary skill in the art to make and use the covers, and the description describes several embodiments of the covers, including what is presently believed to be the best modes of making and using the covers. Exemplary covers are described herein as being useful on paved roadways. However, it is contemplated that the covers and methods of assembly have general application to openings in a broad range of surfaces in a variety of environments other than paved roadways.

Figure 1:
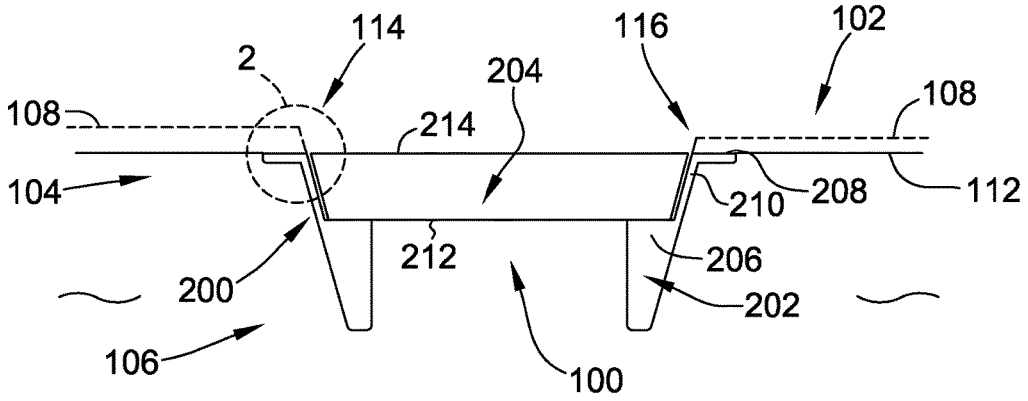
FIG. 1 is a schematic illustration of a cover assembly which is installed over an opening in a paved roadway and is in a state of disrepair.
Figure 2:
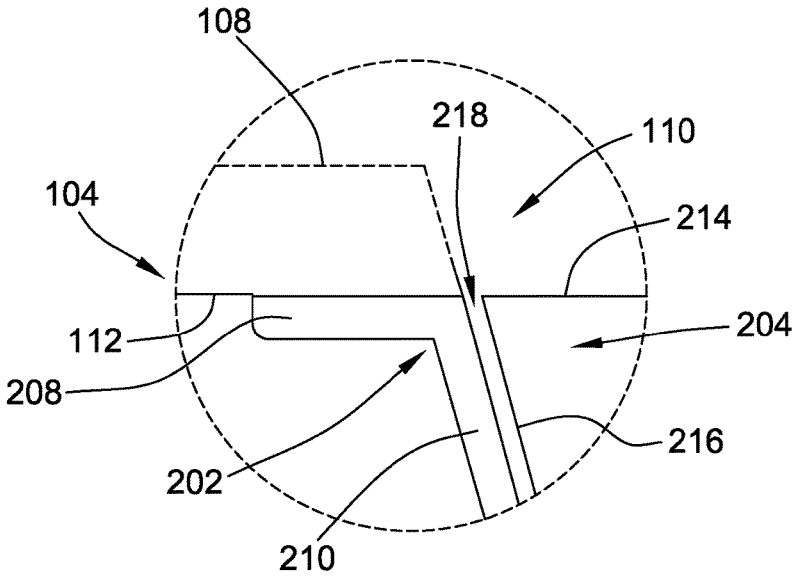
FIG. 2 is an enlarged portion of the schematic illustration shown in FIG. 1 taken within area 2.

FIGS. 1 and 2 are schematic illustrations of a cover assembly 200 for an opening 100 in a paved roadway 102. Cover assembly 200 includes a support frame 202 (e.g., a valve box) and a cover 204 seated on support frame 202 to enclose opening 100. In the exemplary embodiment, opening 100 provides access to a utility valve (not shown). Hence, opening 100 is of the smaller variety (i.e., opening 100 is not sized to permit a service worker to descend beneath roadway), and cover assembly 200 is likewise of the smaller variety (e.g., cover 204 is not a manhole cover and has a load bearing characteristic that is lower than would otherwise be required for a manhole cover). In other embodiments, opening 100 and cover assembly 200 may have any suitable sizes (e.g., cover 204 may be a manhole cover having the associated load bearing characteristic in some embodiments).

In the exemplary embodiment, support frame 202 is made of a metallic material and has a generally Z-shaped cross-section defined by a radially inward rim 206, a radially outward rim 208, and a wall 210 extending obliquely outward from radially inward rim 206 to radially outward rim 208. Support frame 202 is mounted in the pavement 104 (e.g., the asphalt or concrete) of roadway 102 and/or in the ground 106 beneath pavement 104, such that support frame 202 extends circumferentially around opening 100 to define an upper segment 110 of opening 100 above radially inward rim 206.

In the exemplary embodiment, cover 204 has a bottom face 212, a top face 214, and an annular sidewall 216 which tapers from top face 214 to bottom face 212, such that cover 204 has a generally frustoconical cross-section sized to fit within upper segment 110 of opening 100. In some embodiments, support frame 202 may be made of any suitable material (e.g., fiberglass or concrete) that facilitates enabling support frame 202 to function as described herein. In other embodiments, support frame 202 and cover 204 may have any suitable shapes and may be mounted at opening 100 in any suitable manner that facilitates enabling cover assembly 200 to function as described herein. Alternatively, cover assembly 200 may not include support frame 202 (e.g., cover 204 may seat directly on pavement 104 of roadway 102 and/or ground 106 beneath pavement 104 with no intermediate support structure therebetween).

When cover assembly 200 was initially installed in roadway 102 (e.g., before cover 204 was driven over by a vehicle), cover 204 was seated on support frame 202 with bottom face 212 contacting radially inward rim 206, such that sidewall 216 of cover 204 was seated circumferentially against wall 210 of support frame 202 and such that radially outward rim 208 of support frame 202 and top face 214 of cover 204 were oriented substantially parallel to (or substantially flush with) surface 108 of pavement 104 (e.g., radially outward rim 208 and top face 214 were between about one-sixteenth to about one-eighth of an inch below surface 108 of pavement 104 when cover assembly 200 was initially installed).

However, since cover assembly 200 was initially installed, support frame 202 and/or cover 204 have been repositioned relative to one another and relative to surface 108 of pavement 104 as shown in FIGS. 1 and 2. For example, vehicular traffic and ground settling have caused sidewall 216 of cover 204 to no longer be seated circumferentially against wall 210 of support frame 202 (i.e., sidewall 216 and wall 210 are now spaced apart by a gap 218, thereby permitting cover 204 to move within upper segment 110 of opening 100 and generate an unpleasant noise whenever cover 204 is driven over by a vehicle. Additionally, periodic resurfacing of pavement 104 over radially outward rim 208 has caused surface 108 of pavement 104 to be raised from its initial level 112 (i.e., radially outward rim 208 of support frame 202 and top face 214 of cover 204 are no longer substantially parallel with surface 108 of pavement 104), thereby recessing radially outward rim 208 and top face 214 relative to surface 108 (e.g., to a depth of about one-fourth of an inch to about one and a half inches below surface 108) such that vehicles now drop onto cover 204 from surface 108 in a manner that generates an unpleasant driving experience and potential damage to the vehicles. Moreover, the periodic resurfacing of pavement 104 has left an uneven grade of surface 108 across opening 100 (i.e., surface 108 is now sloped across opening 100 relative to cover 204 such that surface 108 is raised higher at a first side 114 of opening 100 than at a second side 116 of opening 100). As such, cover assembly 200 is in a state of disrepair.

Figure 3:
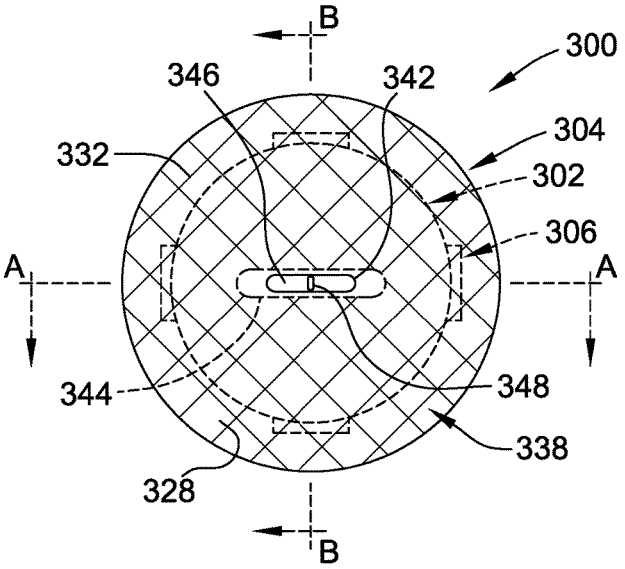
FIG. 3 is a top view of an exemplary cover for use in repairing the cover assembly shown in FIG. 1.
Figure 4:
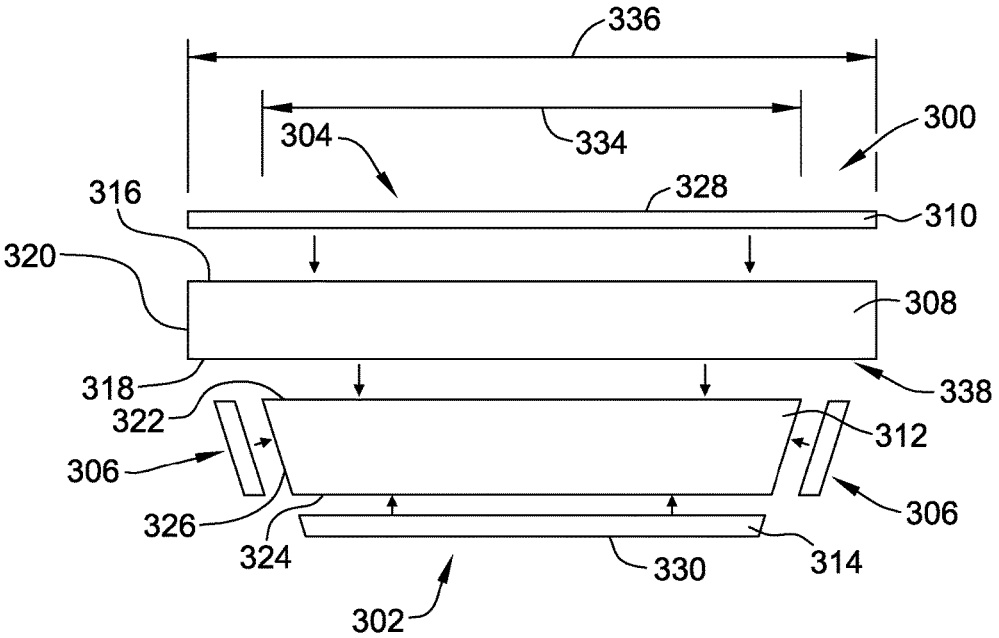
FIG. 4 is an exploded view of the cover shown in FIG. 3.

FIGS. 3 and 4 are schematic illustrations of an exemplary replacement (or retrofit) cover 300 for use in repairing cover assembly 200. In the exemplary embodiment, cover 300 includes a base 302, a cap 304, and a plurality of gripping members 306. Cap 304 has a body 308 and a top plate 310, and base 302 has a body 312 and a bottom plate 314. Body 308 of cap 304 has an upper surface 316, a lower surface 318, and a side surface 320 between upper surface 316 and lower surface 318. Similarly, body 312 of base 302 has an upper surface 322, a lower surface 324, and a side surface 326 which tapers from upper surface 322 to lower surface 324. Top plate 310 is coupled to upper surface 316 of body 308, which is coupled to upper surface 322 of body 312. Bottom plate 314 is coupled to lower surface 324 of body 312, and gripping members 306 are coupled to side surface 326 of body 312 in circumferentially spaced relation to one another. Top plate 310 defines a top face 328 of cover 300, and top face 328 has a non-skid texture (e.g., waffle-type ridges 332). Bottom plate 314 defines a bottom face 330 of cover 300, and bottom face 330 has a substantially flat (or planar) contour. In some embodiments, as used herein, the term "coupled" refers to being separately formed and subsequently joined to one another (e.g., via a bonding process such as vulcanization). In other embodiments, as used herein, the term "coupled" refers to being integrally formed (e.g., molded) to one another as a single-piece, unitary structure.

In the exemplary embodiment, at least cap 304 (and in some embodiments base 302) is made of a material which is rigid (i.e., non-compliant), synthetic or semi-synthetic, and organic-based (i.e., substantially non-metallic) such as, for example, a hard rubber material. As such, at least top plate 310 (and in some embodiments bottom plate 314) can be shaped in the field using a handheld grinding tool, as set forth in more detail below. In the exemplary embodiment, each gripping member 306 is made of a material which is non-rigid (i.e., compliant), synthetic or semi-synthetic, and organic-based (i.e., substantially non-metallic) such as, for example, a soft rubber material. Thus, gripping members 306 can be compliantly sandwiched between base 302 and support frame 202 when cover 300 is installed in place of cover 204, as set forth in more detail below. As used herein, the term "compliant" or any variation thereof refers to being resiliently deformable (e.g., resiliently compressible and/or flexible). In other embodiments, base 302, cap 304, and/or gripping members 306 may be made of any hard, semi-hard, soft, and/or composite polymeric material (e.g., rubber, plastic, etc.) that facilitates enabling cover 300 to function as described herein. In alternative embodiments, bottom plate 314 may be made of a metallic material, rather than a material which is shapeable in the field, to facilitate an enhanced reinforcing function.

In the exemplary embodiment, each gripping member 306 is strip-shaped and may optionally include a plurality of spaced-apart fins (not shown). In other embodiments, gripping members 306 may have any suitable shape that facilitates enabling gripping members 306 to function as described herein. While the exemplary embodiment of cover 300 includes four circumferentially (and substantially equally) spaced-apart gripping members 306, other embodiments of cover 300 may have any suitable quantity of gripping members 306 arranged in any suitable manner. For example, one embodiment of cover 300 may include a single, unitary gripping member 306 which extends circumferentially about body 312 of base 302 along side surface 326, or another embodiment of cover 300 may have twenty-four gripping members 306 that are circumferentially (and substantially equally) spaced apart from one another about body 312 of base 302 along side surface 326. Alternatively, cover 300 may have any suitable gripping member(s) 306 coupled to base 302 and/or cap 304 in any suitable manner that facilitates enabling cover 300 to function as described herein.

In the exemplary embodiment, base 302 has a diameter 334, and cap 304 has a diameter 336 which is larger than diameter 334 such that cap 304 defines a circumferential flange 338 which extends radially outwardly from base 302 and has a height 340 (shown in FIG. 6) (i.e., base 302 and cap 304 together have a generally T-shaped cross-section). As used herein, the terms "radius" and "diameter" (or any variations thereof) refer to parameters measured from, or across, the center of any suitable shape (e.g., a square, a rectangle, a triangle, etc.) and are not limited to parameters measured from, or across, the center of a circular shape. Similarly, as used herein, the term "circumference" (or any variations thereof) refers to a perimetric parameter extending around the center of any suitable shape (e.g., a square, a rectangle, a triangle, etc.) and is not limited to a perimetric parameter extending around the center of a circular shape.

In the exemplary embodiment, cover 300 has a keyway 342 which has an elongate (e.g., oval-shaped) planform shape (as shown in FIG. 3) and which extends linearly through cap 304 and base 302 from top face 328 to bottom face 330. In other embodiments, keyway 342 may have any suitable shape and may extend through cap 304 and/or base 302 in any suitable manner that facilitates enabling cover 300 to function as described herein. In the exemplary embodiment, a groove 344 is defined in cap 304 about at least a peripheral segment of keyway 342, and groove 344 is sized to removably receive a flexible tab 346 which covers keyway 342 and is color-coded to indicate the type of utility that is accessible through opening 100 (e.g., a yellow tab may indicate a general gas utility, a blue tab may indicate a general water utility, a red tab may indicate a general fire hydrant utility, a white tab may indicate a water main, an orange tab may indicate a gas main, etc.). Tab 346 has an aperture 348 which facilitates inserting and removing tab 346 from groove 344, as set forth in more detail below. In other embodiments, cover 300 may have any suitable component for removably covering keyway 342 in any suitable manner that facilitates enabling cover 300 to function as described herein.

FIGS. 5-8 are schematic illustrations of cover assembly 200 during an exemplary procedure to repair cover assembly 200. In general, the exemplary procedure includes replacing cover 204 with cover 300, but the procedure does not include elevating support frame 202 in pavement 104, pouring new pavement, or resurfacing pavement 104. In other embodiments, however, the procedure may include any suitable steps that facilitate utilizing cover 300 in the manner set forth herein. While cover 300 is described herein as being particularly useful in repairing cover assembly 200 which is in disrepair, it is contemplated that cover 300 is nonetheless useful together with a support frame like support frame 202 for installation as a new cover assembly in a new roadway or an old roadway (i.e., retrofit applications are not the only contemplated applications of cover 300).

Figure 5:
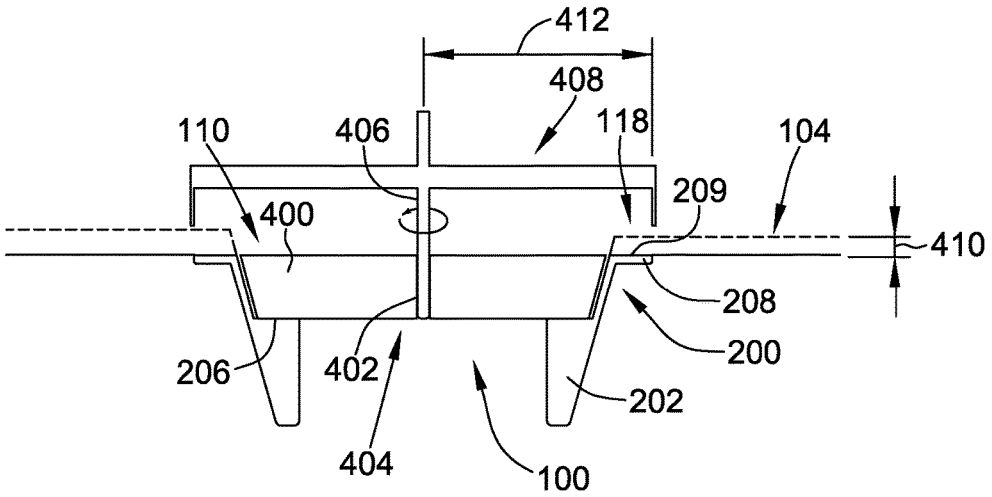
FIG. 5 is a schematic illustration of the cover assembly shown in FIG. 1 during a step in an exemplary procedure to repair the cover assembly using the cover shown in FIG. 3.

With reference to FIG. 5, the exemplary procedure to repair cover assembly 200 includes removing (and discarding) cover 204 from upper segment 110 of opening 100 and then seating a guide lid 400 (e.g., a drilling-type lid) on radially inward rim 206 of support frame 202 within upper segment 110 of opening 100. Guide lid 400 has a hole 402 in its center region 404, and hole 402 receives a guide bit 406 of a pavement cutting tool 408 (e.g., a concrete hole saw) to assist in cutting away a margin 118 of pavement 104 that covers radially outward rim 208 of support frame 202 around opening 100. For example, when cutting away margin 118, pavement 104 may be sawed to a depth 410 just below the top surface 209 of radially outward rim 208 (e.g., to a depth of about one-sixteenth of an inch below the top surface 209 of radially outward rim 208) at a radius 412 just beyond radially outward rim 208 from hole 402 (e.g., at a radius of about one-eighth of an inch beyond radially outward rim 208 from hole 402).

Figure 6:
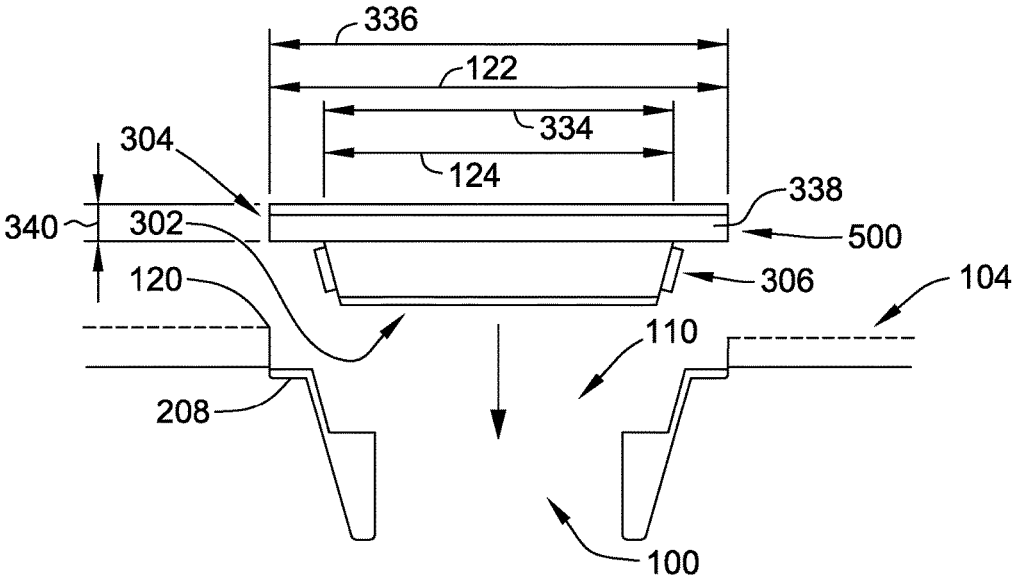
FIG. 6 is a schematic illustration of the cover assembly shown in FIG. 1 during a subsequent step in the procedure shown in FIG. 5 to repair the cover assembly using the cover shown in FIG. 3.

Referring now to FIG. 6, after margin 118 of pavement 104 is cut away, guide lid 400 is removed from upper segment 110 of opening 100, and cutaway margin 118 is cleared from the area surrounding opening 100 in a suitable manner. For example, larger blocks of cutaway margin 118 may be removed by hand, while an abrasion tool such as a wire brush (not shown) may be used to smoothen jagged segments of sawed pavement edge 120 and dislodge loose particles of cutaway margin 118 from tight spaces such as corners or crevices around radially outward rim 208. Any remaining debris from cutaway margin 118 may then be cleared from the area surrounding opening 100 using a vacuum, and sawed pavement edge 120 may be coated with a suitable sealant (e.g., a bitumen slurry applied via a paint brush (not shown)). With margin 118 having been removed, the size of upper segment 110 of opening 100 has effectively been increased, in that upper segment 110 now has a larger upper diameter 122, while the length of its lower diameter 124 remains unchanged by the cutting away of margin 118.

After cutaway margin 118 is cleared from the area surrounding opening 100, a suitable cover 500 is selected to replace cover 204. Cover 500 is selected from a kit having a plurality of preassembled covers 300 each with its base 302, cap 304, and gripping members 306 having already been coupled together before being brought into the field. While the kit has a plurality of preassembled covers 300 in the exemplary embodiment, at least one cover 300 in the kit may not be preassembled in other embodiments, such that the assembly of cover(s) 300 is required in the field (e.g., such that base 302, cap 304, and/or gripping members 306 of at least one cover 300 in the kit need to be coupled together in the field). At least one dimension (e.g., diameter 334 of base 302, diameter 336 of cap 304, and/or height 340 of flange 338) of one cover 300 in the kit differs from that of another cover 300 in the kit, such that each differently dimensioned cover 300 in the kit is useful in repairing a differently sized cover assembly 200 in the field.

After selecting cover 500 from the kit, cover 500 is inserted within opening 100 to test its fit. Cover 500 is first tested to determine whether it is the proper diametrical size (e.g., to test whether diameter 336 of cap 304 substantially matches upper diameter 122 of upper segment 110, and to test whether diameter 334 of base 302 substantially matches lower diameter 124 of upper segment 110). If the diametrical size is proper, the functionality of pre-assembled gripping members 306 is then tested, particularly the manner in which pre-assembled gripping members 306 resist the rotation of cover 500 within upper segment 110 and/or the lifting of cover 500 out of upper segment 110. If pre-assembled gripping members 306 do not provide enough resistance to rotation or lifting of cover 500, additional gripping members 306 may be coupled to cover 500 in the field as desired.

Figure 7:
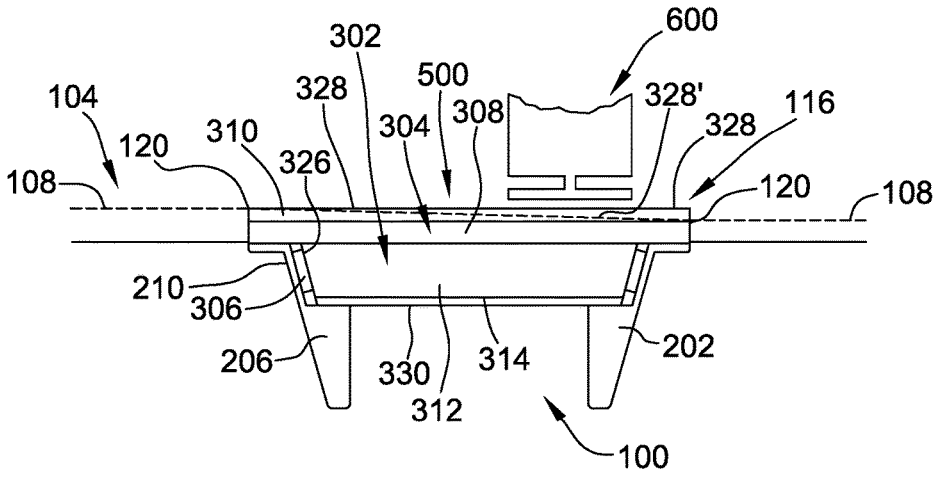
FIG. 7 is a schematic illustration of the cover assembly shown in FIG. 1 during a subsequent step in the procedure shown in FIG. 6 to repair the cover assembly using the cover shown in FIG. 3.

As shown in FIG. 7, after the diametrical size and the grip of cover 500 are tested, the height of top face 328 in relation to sawed pavement edge 120 about the circumference of opening 100 is then tested and adjusted. To test the height of top face 328, cover 500 is set in place on support frame 202 using a setting tool (not shown) (e.g., a handheld ground tamper) such that bottom face 330 of cover 500 is firmly seated on radially inward rim 206 of support frame 202, and such that side surface 326 of base 302 is seated adjacent wall 210 of support frame 202 with gripping members 306 sandwiched therebetween to effectively resist displacement of cover 500 relative to support frame 202 while also cushioning the interface between cover 500 and support frame 202 to effectively reduce noise generated when a vehicle drives over cover 500.

It is desirable for top face 328 to sit just below (e.g., within a predefined tolerance of between about one-sixteenth of an inch to about one-eighth of an inch below) sawed pavement edge 120 around the entire circumference of opening 100 (i.e., it is undesirable for top face 328 to sit above sawed pavement edge 120 or too far below sawed pavement edge 120). Because the grade of surface 108 of pavement 104 slopes across opening 100 in the exemplary application, top face 328 of cover 500 sits above sawed pavement edge 120 at second side 116 of opening 100 when cover 500 is first seated within upper segment 110 of opening 100, which is undesirable as set forth above. To adjust the height of top face 328 at second side 116 of opening 100, the contour of bottom face 330 and/or the contour of top face 328 are reshaped in the field using a handheld grinding tool 600 until top face 328 sits just below sawed pavement edge 120 at second side 116 of opening 100 as indicated by reshaped top face contour line 328' (e.g., until the drop from sawed pavement edge 120 onto cover 500 is within the predefined tolerance around the entire circumference of opening 100).

Figure 8:
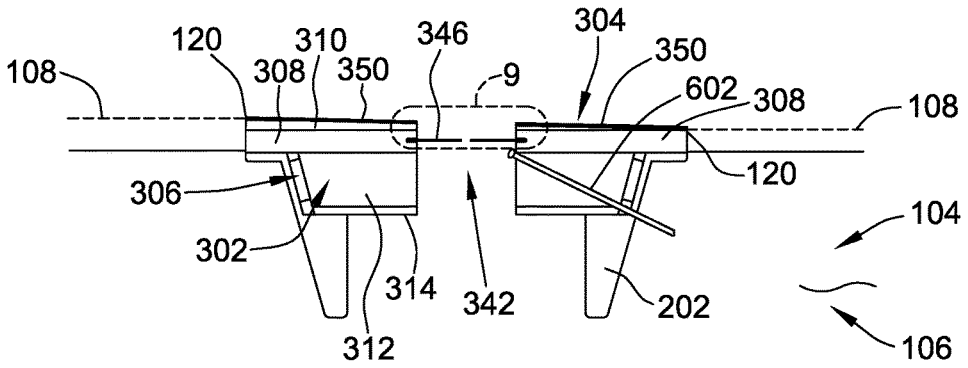
FIG. 8 is a schematic illustration of the cover assembly shown in FIG. 1 during a subsequent step in the procedure shown in FIG. 7 to repair the cover assembly using the cover shown in FIG. 3 (Note: the cover is depicted in FIG. 8 by a cross-section of the cover taken along plane A-A of FIG. 3)

Referring now to FIG. 8, each cover 300 in the kit may come with a non-skid panel 350 that can be coupled to top plate 310 in the field if the non-skid texture (e.g., waffle-type ridges 332) of top face 328 is removed when reshaping the contour of top face 328. As another option, after the contour of top face 328 of cover 500 has been reshaped in the field to suit the grade of surface 108 of pavement 104, a fastener 602 (e.g., a screw) may be inserted through cover 500, through support frame 202, and into pavement 104 via keyway 342 to facilitate preventing cover 500 from rotating relative to support frame 202 over time. After the contour of top face 328 has been reshaped such that top face 328 has an acceptable height relative to sawed pavement edge 120 (and non-skid panel 350 has been coupled to top plate 310 and/or cover 500 has been secured using fastener 602), the appropriately colored tab 346 is inserted into groove 344 of top plate 310, thereby covering keyway 342 (and optionally fastener 602) to complete the procedure to repair cover assembly 200.

Figure 9:
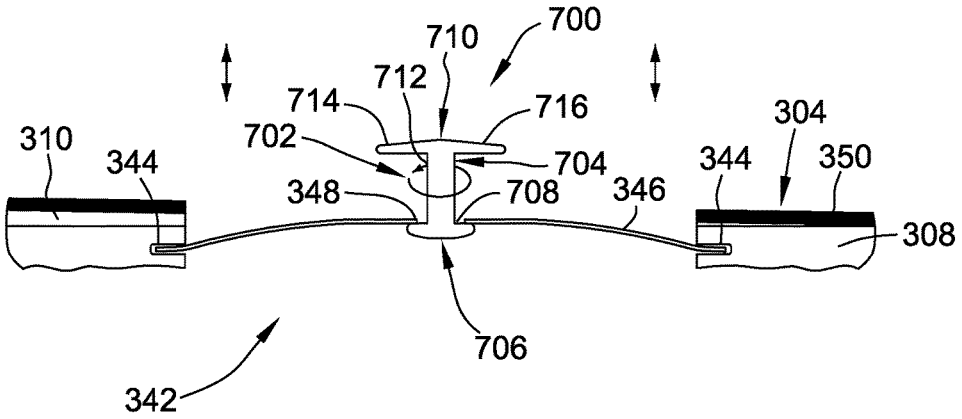
FIG. 9 is an enlarged schematic illustration of the repaired cover assembly shown in FIG. 8 taken within region 9 during a step in a procedure to remove the cover shown in FIG. 3.
Figure 10:
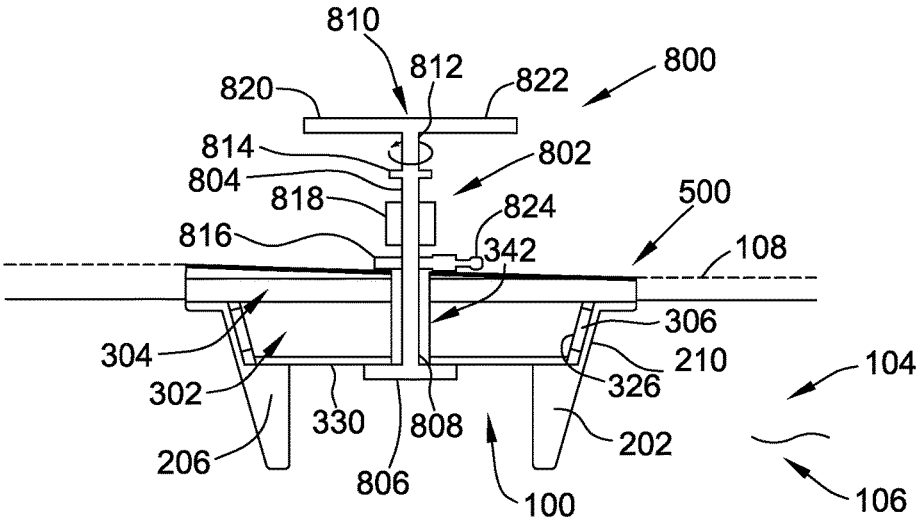
FIG. 10 is a schematic illustration of the repaired cover assembly shown in FIG. 8 during a subsequent step in the procedure shown in FIG. 9 to remove the cover shown in FIG. 3 (Note: the cover is depicted in FIG. 10 by a cross-section of the cover taken along plane B-B of FIG. 3)

FIGS. 9 and 10 are schematic illustrations of repaired cover assembly 200 during an exemplary procedure to remove cover 500 (e.g., when servicing utilities that run underneath pavement 104). In the exemplary embodiment, repaired cover assembly 200 is tamper-resistant, in that gripping members 306, tab 346, and optionally fastener 602 make it difficult for unauthorized personnel to remove cover 500 from opening 100 without the proper tools. As such, authorized personnel is provided with a kit of tools for removing cover 500 from opening 100, and the kit includes a tab-pulling tool 700 and/or a cover-lifting tool 800.

As shown in FIG. 9, in the exemplary embodiment, tab-pulling tool 700 is a pin 702 having a body 704, a head 706 which extends radially outward from a first end 708 of body 704, and a grip 710 which extends radially outward from a second end 712 of body 704 opposite first end 708. Aperture 348 of tab 346 and head 706 of pin 702 are sized such that head 706 is insertable into aperture 348 but, when rotated after insertion, cannot be withdrawn from aperture 348. As such, tab 346 is removable from keyway 342 by holding grip 710 (e.g., by placing an index finger under a first side 714 of grip 710 and a middle finger under a second side 716 of grip 710), inserting head 706 through aperture 348, rotating head 706 relative to tab 346, and pulling pin 702 away from cover 500 such that tab 346 flexibly withdraws from groove 344 and detaches from cap 304. Once tab 346 has been removed from keyway 342, pin 702 can be rotated within aperture 348 to permit the removal of head 706 from aperture 348 as desired. Notably, while tab-pulling tool 700 is described herein as being useful in pulling tab 346 from keyway 342, tab-pulling tool 700 is nonetheless useful when inserting tab 346 into keyway 342 (i.e., tab-pulling tool 700 can facilitate holding tab 346 in place while tab 346 is flexibly inserted into groove 344). In other embodiments, tab-pulling tool 700 may have any suitable configuration that facilitates inserting and/or removing tab 346 in a manner that enables tab 346 to function as described herein (e.g., tab-pulling tool 700 may be a screwdriver in some embodiments).

As shown in FIG. 10, in the exemplary embodiment, cover-lifting tool 800 is a key 802 having a shaft 804, a head 806 which extends radially outward from a first end 808 of shaft 804, and a handle 810 which extends radially outward from a second end 812 of shaft 804. Key 802 also includes a stop 814 coupled to shaft 804 near handle 810, a lock 816 (e.g., a nut or clamp) manually positionable along shaft 804 between stop 814 and head 806, and a ring 818 slidable along shaft 804 between lock 816 and stop 814. Keyway 342 of cover 500 and head 806 of key 802 are sized such that head 806 is insertable into keyway 342 but, when rotated after insertion, head 806 cannot be withdrawn from keyway 342.

As such, cover 500 is removable from opening 100 by first removing fastener 602 from keyway 342 if applicable. Next, handle 810 is grasped (e.g., by placing a first side 820 of handle 810 between the palm and all fingers of one hand, and by placing a second side 822 of handle 810 between the palm and all fingers of the other hand). Head 806 is inserted through keyway 342 using handle 810, and then head 806 is rotated relative to cover 500 such that head 806 cannot be withdrawn from keyway 342. Subsequently, lock 816 is positioned in contact with cap 304 of cover 500 such that cover 500 is firmly sandwiched between head 806 and lock 816. Lock 816 is then manually fixed in place on shaft 804 (e.g., via a set screw 824). Once lock 816 has been fixed in place on shaft 804, ring 818 can be repeatedly and forcibly slid upward along shaft 804 to hammer stop 814 until cover 500 is dislodged from opening 100 (i.e., until the resistance of gripping members 306 is relieved). After dislodging cover 500 from opening 100 using ring 818 and stop 814, handle 810 can be grasped in the manner set forth above and pulled upward to fully remove cover 500 from opening 100.

To later place cover 500 back in opening 100 after the utility servicing operation is complete, handle 810 can be grasped in the manner set forth above and used to lower cover 500 into opening 100. Cover 500 is then rotated within opening 100 using handle 810 to properly orient cover 500 relative to the grade of surface 108 of pavement 104. Once cover 500 is properly oriented, lock 816 is unfixed from shaft 804 to loosen cover 500 between head 806 and lock 816. Head 806 is then rotated and withdrawn from keyway 342 using handle 810. Cover 500 can then be set in place on support frame 202 using a setting tool (not shown) (e.g., a handheld ground tamper) such that bottom face 330 of base 302 is firmly seated on radially inward rim 206 of support frame 202, and such that side surface 326 of base 302 is seated adjacent wall 210 of support frame 202 with gripping members 306 sandwiched therebetween. Fastener 602 is then reinserted through cover 500, through support frame 202, and into pavement 104 via keyway 342 if desired. Tab 346 is then reinserted into groove 344 to again cover keyway 342. In other embodiments, cover 500 may be removed from and/or inserted into opening 100 in any suitable manner that facilitates enabling cover 500 to function as described herein (e.g., cover 500 may instead be removed using a pick, a digging bar, or a hook that is otherwise used to remove a manhole cover).

Figure 11:
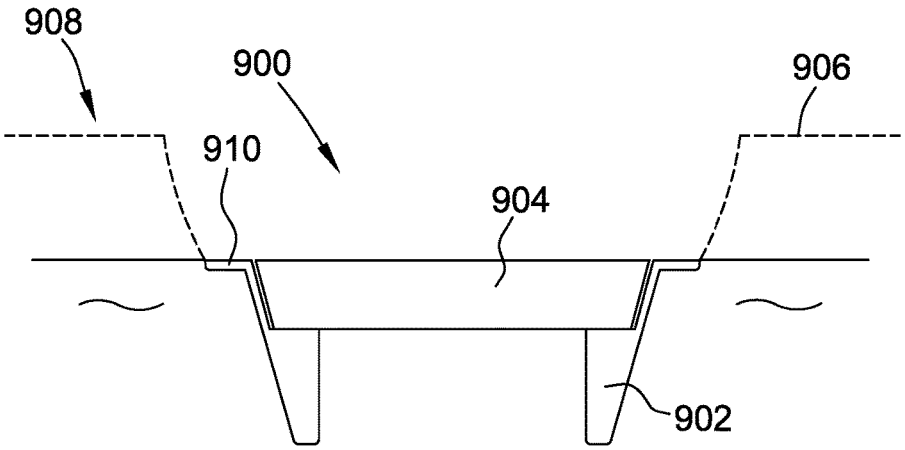
FIG. 11 is a schematic illustration of another cover assembly which is installed over an opening in a paved roadway and is in a state of disrepair.

FIG. 11 is a schematic illustration of another cover assembly 900 that is in a state of disrepair. Cover assembly 900 includes a support frame 902 (e.g., a valve box) and a cover 904 that are the same as support frame 202 and cover 204 set forth above. Like cover assembly 200, support frame 902 and/or cover 904 have been undesirably repositioned relative to one another and relative to a surface 906 of pavement 908 over time. However, unlike cover assembly 200, pavement 908 surrounding cover assembly 900 has been resurfaced such that pavement 908 does not cover radially outward rim 910 of support frame 902, but instead slopes away from radially outward rim 910. Additionally, pavement 908 has been resurfaced such that surface 906 is higher in relation to cover 904 than is surface 108 in relation to cover 204 (e.g., such that surface 906 is more than two inches above cover 904). Moreover, unlike cover 204 of cover assembly 200, it is preferable that cover 904 of cover assembly 900 not be replaced (e.g., cover 904 is considered a relic and should be reused if possible).

Figure 12:
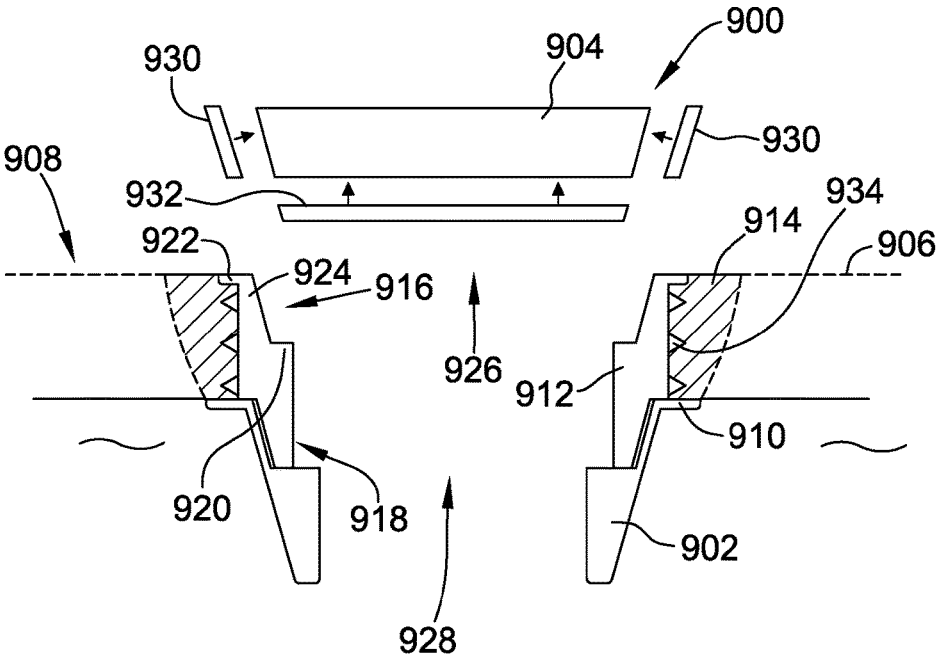
FIG. 12 is a schematic illustration of the cover assembly shown in FIG. 11 during an exemplary procedure to repair the cover assembly.

FIG. 12 is a schematic illustration of cover assembly 900 during an exemplary procedure to repair cover assembly 900. As set forth above, the procedure is particularly useful when: (a) pavement 908 slopes away from support frame 902 toward surface 906; (b) pavement 908 has been resurfaced such that surface 906 of pavement 908 is at a higher level in relation to cover 904; and/or (c) it is preferable that cover 904 not be replaced. In the exemplary embodiment, cover assembly 900 is repaired by attaching (e.g., welding) a riser 912 to support frame 902 (e.g., to radially outward rim 910) and pouring new pavement 914 between existing pavement 908 and riser 912. Notably, an upper portion 916 of riser 912 is shaped the same as an upper portion 918 of support frame 902 (e.g., upper portion 916 of riser 912 has a radially inward rim 920, a radially outward rim 922, and a wall 924 between rims 920 and 922). As such, riser 912 effectively forms a new upper segment 926 of opening 928 at the level of surface 906. Optionally, at least one gripping member 930 like gripping members 306 may be attached to cover 904 for sandwiching between cover 904 and riser 912 to facilitate preventing displacement of cover 904 relative to riser 912 within opening 928 and to facilitate cushioning the interface between cover 904 and riser 912, and/or a compliant gasket 932 may be seated between cover 904 and riser 912 to facilitate preventing liquid from infiltrating opening 928 around cover 904. Moreover, in some embodiments, riser 912 may have a plurality of ribs 934 and/or other suitable deformation(s) that facilitate embedding or otherwise adhering riser 912 to new pavement 914.

The methods and systems described herein facilitate repairing existing cover assemblies and installing new cover assemblies in pavement. For example, the methods and systems facilitate repairing and installing utility valve cover assemblies in paved roadways. The methods and systems facilitate raising part of an existing cover assembly up to the grade of the surrounding pavement, thereby reducing the noise and the impact wear on the tires of vehicles driving over the cover assembly. Furthermore, the methods and systems facilitate raising part of an existing cover assembly up to the grade of the surrounding pavement in a manner that accounts for the slope of the grade across the cover assembly. The methods and systems also facilitate reducing the displacement of an underground access cover in a roadway over time by resisting rotation and lifting of the cover from its opening, while also cushioning the interface between the cover and its support frame to reduce the noise associated with vehicles driving over the cover. As such, the methods and systems facilitate increasing the wear resistance of underground access covers in paved roadways. Additionally, the methods and systems facilitate repairing cover assemblies in a manner that renders the underlying utility identifiable by a service worker viewing a cover of the assembly from the roadway. The methods and systems further facilitate repairing cover assemblies in a manner that increases their resistance to tampering. The methods and systems therefore facilitate effectively repairing existing cover assemblies and/or installing new cover assemblies in a manner that is less labor intensive, less time consuming, and less expensive.

Exemplary embodiments of underground access covers and methods of assembling the same are described above in detail. The methods and systems described herein are not limited to the specific embodiments described herein, rather some components of the systems and steps of the methods may be utilized independently and separately from other components and steps described herein. For example, the methods and systems described herein may have other applications not limited to use in openings of paved roadways, as described herein. Rather, the methods and systems described herein can be implemented and utilized in connection with various other industries.

While the invention has been described in terms of various specific embodiments, those skilled in the art will recognize that the invention can be practiced with modification within the spirit and scope of the claims.

What is claimed is:

1. A method of assembling an underground access cover over an access opening defined in pavement, said method comprising:

inserting the underground access cover into the access opening such that a base of the underground access cover is received in a clearance fit in a first segment of the access opening and a cap of the underground access cover is received in a clearance fit in a second segment of the access opening, wherein the base is formed from a substantially non-metallic material, wherein the base has a diameter and includes a bottom face of the underground access cover, wherein the cap is formed from a substantially non-metallic material, wherein the cap has a diameter that is longer than the diameter of the base, wherein the cap is coupled to the base such that the cap extends radially outward from the base to define a flange of the cover, and wherein the cap includes a top face of the underground access cover; and removing material from one of the top face and the bottom face such that the top face is at least partially sloped relative to the bottom face to correspond to a slope in the pavement around the access opening.

2. A method in accordance with claim 1, wherein the cap is formed from a rubber material, said removing material comprises grinding the top face.

3. A method in accordance with claim 2, wherein the base is formed from a rubber material, said removing material comprises grinding the bottom face.

4. A method in accordance with claim 1, wherein said inserting the underground access cover comprises inserting the base and the cap integrally molded together as a single, unitary structure.

5. A method in accordance with claim 1, wherein said inserting the underground access cover comprises inserting the cap having a non-skid texture on a top face of the cap.

6. A method in accordance with claim 1, wherein the base includes a tapered side surface that extends circumferentially around the base and defines the diameter of the base, and wherein the underground access cover further includes at least one resiliently flexible gripping member that extends radially outward from the side surface, said method further comprising compliantly sandwiching the at least one gripping member between the base and a support frame defining the first segment of the access opening.

7. A method in accordance with claim 1, further comprising inserting a fastener through a keyway predefined through the base and the cap.

8. A method in accordance with claim 7, further comprising coupling a tab to the cap over the keyway after said inserting the fastener to indicate a utility type.

* * * * *